US012018421B2

(12) United States Patent
Mccambridge et al.

(10) Patent No.: US 12,018,421 B2
(45) Date of Patent: Jun. 25, 2024

(54) LAUNDRY LOAD SOIL LEVEL DETECTION SYSTEM

(71) Applicant: FISHER & PAYKEL APPLIANCES LIMITED, Auckland (NZ)

(72) Inventors: Sophia Elizabeth Constance Mccambridge, Auckland (NZ); Stephen Leonard Greig, Auckland (NZ); Jennifer Ellen Trittschuh-Valles, Auckland (NZ); Zhouhao Zheng, Auckland (NZ)

(73) Assignee: FISHER & PAYKEL APPLIANCES LIMITED, Auckland (NZ)

( * ) Notice: Subject to any disclaimer, the term of this patent is extended or adjusted under 35 U.S.C. 154(b) by 310 days.

(21) Appl. No.: 17/277,387

(22) PCT Filed: Sep. 18, 2019

(86) PCT No.: PCT/NZ2019/050127
§ 371 (c)(1),
(2) Date: Mar. 18, 2021

(87) PCT Pub. No.: WO2020/060420
PCT Pub. Date: Mar. 26, 2020

(65) Prior Publication Data

US 2022/0034015 A1 Feb. 3, 2022

(30) Foreign Application Priority Data

Sep. 18, 2018 (NZ) ..... 746460

(51) Int. Cl.
*D06F 33/34* (2020.01)
*D06F 21/04* (2006.01)
(Continued)

(52) U.S. Cl.
CPC ..... *D06F 33/34* (2020.02); *D06F 21/04* (2013.01); *D06F 33/37* (2020.02); *D06F 39/02* (2013.01);
(Continued)

(58) Field of Classification Search
CPC ..... D06F 33/34; D06F 33/36; D06F 33/37; D06F 33/54; D06F 33/56; D06F 33/57;
(Continued)

(56) References Cited

U.S. PATENT DOCUMENTS 4,222,250 A 9/1980 Torita
5,136,861 A 8/1992 Kiuchi et al.
(Continued)

FOREIGN PATENT DOCUMENTS

CN 105063956 11/2015
CN 105088651 11/2015
(Continued)

OTHER PUBLICATIONS

International Search Report, PCT/NZ2019/050127, Form PCT/ISA/210, dated Oct. 31, 2019.
(Continued)

*Primary Examiner* — David G Cormier
(74) *Attorney, Agent, or Firm* — Clark Hill PLC

(57) ABSTRACT

A laundry washing machine and method of operating same for the purpose of automatically determining a soil level of a laundry load from two turbidity readings taken before a washing cycle commences, such as during a pre-wash, filling phase. The machine is configured to detect a load size, add a first amount of water and take a first turbidity reading. A first dose of detergent is then added, a second amount of water added and the wetted load is gently tumbled/agitated before taking a second turbidity reading. A value based upon a ratio of the turbidity readings can determine the soil level
(Continued)

of the load in order to choose a wash-related parameter, such as how much detergent to use for the subsequent complete wash cycle and/or the duration thereof.

20 Claims, 6 Drawing Sheets

(51) Int. Cl.

| | |
|---|---|
| ***D06F 33/37*** | (2020.01) |
| ***D06F 39/02*** | (2006.01) |
| *D06F 103/04* | (2020.01) |
| *D06F 103/18* | (2020.01) |
| *D06F 103/20* | (2020.01) |
| *D06F 105/10* | (2020.01) |
| *D06F 105/42* | (2020.01) |

(52) U.S. Cl.
CPC ..... *D06F 2103/04* (2020.02); *D06F 2103/18* (2020.02); *D06F 2103/20* (2020.02); *D06F 2105/10* (2020.02); *D06F 2105/42* (2020.02)

(58) Field of Classification Search
CPC ..... D06F 34/22; D06F 2103/04; D06F 2103/18; D06F 2103/20; D06F 2105/02; D06F 2105/42; D06F 2105/52; D06F 2105/54
See application file for complete search history.

(56) References Cited

U.S. PATENT DOCUMENTS

| | | | | |
|---|---|---|---|---|
| 5,235,827 | A * | 8/1993 | Kiuchi | D06F 33/44 706/900 |
| 9,709,505 | B2 | 7/2017 | Choi et al. | |
| 2017/0342639 | A1 | 11/2017 | Kim | |
| 2018/0002857 | A1* | 1/2018 | Hombroek | D06F 35/005 |

FOREIGN PATENT DOCUMENTS

| | | |
|---|---|---|
| CN | 105155202 | 12/2015 |
| EP | 0454862 | 11/1991 |
| EP | 1741377 | 1/2007 |
| JP | 4067896 | 3/2008 |
| JP | 2018130238 | 8/2018 |

OTHER PUBLICATIONS

International Preliminary Report on Patentability & Written Opinion of the International Searching Authority, PCT/NZ2019/050127, Form PCT/B/373 & Form PCT/ISA/237, dated Mar. 23, 2021.
Bosch 7875 ecologixx8 & idos brochure 2011.

* cited by examiner

LAUNDRY LOAD SOIL LEVEL DETECTION SYSTEM

This application is a National Phase Filing of PCT/NZ2019/050127, having an International filing date of Sep. 18, 2019, which claims priority of New Zealand Patent Application No. 746460, filed Sep. 18, 2018. The disclosure of the foregoing is hereby incorporated by reference.

TECHNICAL FIELD

The present invention relates to laundry washing machines and/or methods of operation of laundry washing machines, and in particular to improvements in sensing laundry load soil level for the purpose of determining a required amount of detergent for use in a laundry washing machine during a washing cycle of that laundry load.

BACKGROUND TO THE INVENTION

In a laundry washing machine, whether a horizontal-axis- or vertical-axis-type machine, the machine performs a series of cycles/phases specific to a chosen wash setting, usually beginning with a wash cycle, proceeding through one or more rinse phases and ending with one or more spin (centrifugal drying) phase. In order to commence washing with a typical laundry machine, a user may choose an appropriate wash setting from a menu (for example, light or heavy soiling, type or weight of fabric, hot or cold water temperature (or, for example an 'Everyday' cycle that sets common wash cycle parameters such as cycle duration, gentleness of washing action and water temperature for 'normally' soiled clothes), add the laundry load to the machine, deposit a detergent manufacturer's recommended amount of detergent in a receptacle and press a 'start' button. Water is automatically admitted to the machine, usually to an outer tub or other water container within which a perforated drum or bowl containing the laundry load rotates. Dependent on the wash setting chosen the machine may, in the case of a vertical-axis machine, fill or partially fill the water container to submerge the washing load in a deep wash, or a lesser volume of water may be admitted and this may be recirculated through the laundry load by a recirculation pump and appropriate spray nozzle. In the case of the washing cycle of a horizontal-axis machine, vanes on the inner surface of the drum repeatedly lift and drop items of the load from a volume of water that is much smaller than would be used for washing that same load size in a vertical-axis machine.

Various additional features and, particularly, automatic functions are also known in the art of laundry washing machines. For example: a weight estimator or sensor can determine how heavy a load is and automatically adjust the washing cycle accordingly; or a turbidity sensor can measure clarity of the wash liquid to determine when a load is clean enough for the cycle to end. It is also known to provide automatic detergent dispensing apparatus to the laundry washing machine, usually including storage of a bulk (liquid) detergent volume and a metering device to release a predetermined dosage of detergent into the wash for each clothes load.

So-called 'intelligent' systems with multiple sensors reportedly optimise the energy usage, water consumption and cycle duration for washing.

For example, JP04067896A discloses detecting a change in turbidity during a washing cycle, between consecutive agitation periods, and uses the change in turbidity to determine whether to add additional detergent and water. The system appears to iteratively add detergent until the (negative) turbidity change between consecutive periods is less than a predetermined value.

EP0454826A discloses a laundry machine capable of monitoring changes in turbidity during a washing cycle to determine whether powder or liquid detergent has been used and measures the time at which the turbidity value levels out to a minimum, during the washing cycle. From that measured time, and the turbidity value at that time, the machine determines whether any additional washing time is required. If the degree of soiling of a load exceeds a level corresponding to the maximum additional time value, then the strength of the water current or the amount of detergent can be increased.

U.S. Pat. No. 5,136,861A discloses a similar capability to EP0454826A except that a change in turbidity is calculated between machine start (that is, when no water is present around the turbidity sensor) and a point in time when turbidity of the wash liquid stops changing. The measured value is used to determine whether a predetermined length of the washing cycle, based on a detected load volume, should be changed or stay the same.

U.S. Pat. No. 4,222,250A describes the use of a turbidity detector for detecting the transparency of washing liquid at an initial stage of the washing cycle and supplies an output signal to an electronic timer so as to set an operating time for the washing and rinsing cycles. The timer determines the length of time taken (from the start of the washing cycle) for the transparency of the washing liquid to reach 20% of the transparency of clean water. This time represents the level of staining of the load and is subsequently used to set washing parameters including the duration of the washing cycle, the duration of the rinsing cycle, the duration of the overflow rinsing cycle, and the number of rinsing cycles. The described process occurs once water filling has stopped and washing has started.

In general, the prior art described herein discloses systems with turbidity measurement effectively detecting when the load has nearly given up all of its soil to the water (and so is nearly clean) so that the wash cycle may be terminated. There is no disclosure regarding predicting, prior to washing, what the soil level of the load is, before (or by the time) washing of the load commences, or before (or by the time) water filling ends, or in a pre-wash 'sensing' phase. As such it has not been possible to automatically dispense an appropriate amount of detergent for any particular washing load prior to commencing washing, nor to set other soil-level-dependent wash parameters, such as wash cycle duration, prior to washing commencing. The prior art techniques therefore do not enable suitable wash parameters to be used for an entire wash cycle nor do they enable the amount of detergent to be reduced in many cases. The prior art techniques also do not provide consistent results for different load sizes given that they do not take into account the effect that load size has on the amount of water added to the water container so that a predetermined water level is achieved and how that alters the clarity of the washing liquid.

SUMMARY OF INVENTION

The present invention seeks to provide a laundry washing machine and/or methods for the operation of a laundry washing machine that has a function associated with being able to automatically determine the amount or quantity or volume or mass of detergent that will be needed for effective washing of a particular laundry load. Preferably, the laundry washing machine is capable of estimating or detecting the size of the laundry load (such as its mass). Preferably the laundry washing machine is also provided with an automatic detergent dispensing apparatus that is then capable of dispensing the determined amount of detergent that corresponds to the load size being washed. At the least the laundry machine of the invention should provide the public with a useful choice.

In a first aspect the invention consists in a laundry washing machine comprising:

a water container within which is supported a rotatable perforated drum for receiving a laundry load and to which a supply of water is admittable in use via a valve to create a washing liquid for washing the laundry load;

a motor for rotating the drum;

a liquid clarity sensor for sensing the clarity of the washing liquid in the water container; and a controller configured to:

prior to the commencement of a washing cycle, of the laundry load, activate the valve to initiate filling of the water container with an amount of water for use in subsequently washing the laundry load during the washing cycle, and by the time that the water fill ends, determine the soil level of the laundry load using the liquid clarity sensor, and commence a washing cycle of the laundry load after the water fill ends wherein at least one wash parameter of the washing cycle is set by the controller based upon the detected soil level.

Preferably, a laundry load size detection system is connected to the controller for detecting the size of the laundry load, and a detergent dispenser is provided for dispensing detergent, under instruction by the controller, into the washing liquid, wherein the controller is configured, prior to the commencement of the washing cycle of the laundry load, to:

detect the size of the laundry load using the laundry load size detection system;

activate the detergent dispenser to dispense a first amount of detergent;

activate the valve to admit a first amount of water into the water container as an initial part of the water fill;

carry out a first controlled soil release from the laundry load into the washing liquid by activating the motor to control the drum's rotational speed over a first limited duration of time;

sense a first washing liquid clarity measurement using the liquid clarity sensor;

activate the valve to admit a second amount of water into the water container as a further part of the water fill;

carry out a second controlled soil release from the laundry load into the washing liquid by activating the motor to control the drum's rotational speed over a second limited duration of time;

sense a second washing liquid clarity measurement using the liquid clarity sensor;

determine the soil level of the laundry load from a ratio, or a difference, between the first and second washing liquid clarity measurements; and based on the detected load size and soil level, set said at least one wash parameter for washing the laundry load.

In a second aspect, the invention consists in a method of operating a laundry washing machine having a laundry load in a water container thereof, comprising the steps of:

filling the water container with an amount of water for use in subsequently washing the laundry load during a washing cycle, determining the soil level of the laundry load using a liquid clarity sensor by the time that the water fill ends, and commencing the washing cycle of the laundry load after the water fill ends wherein at least one wash parameter of the washing cycle is set by the controller based upon the determined soil level.

Preferably, the method further comprises the steps of:

detecting the size of the laundry load;

dispensing a first amount of detergent to the water container;

admitting a first amount of water into the water container as an initial part of the water fill;

sensing a first washing liquid clarity measurement;

admitting a second amount of water into the water container as a further part of the water fill;

carrying out at least one controlled soil release from the laundry load into the washing liquid by controlling the drum's rotational speed over a limited duration of time;

sensing a second washing liquid clarity measurement;

determining the soil level of the laundry load from a ratio, or a difference, between the first and second washing liquid clarity measurements; and based on the detected load size and soil level, setting said at least one wash parameter for washing the laundry load.

It will be apparent that the inventive concept may involve determining, before the start of a washing cycle (that is, in a pre-wash phase during a water filling phase), how clean or soiled the laundry load is so that a required amount of detergent for any particular load, and/or the length of the washing phase required for that particular load (or, conceivably, other wash-related parameters), can be set for that load. So-called "intelligent washing" may be a selectable option that a user can choose in lieu of a user-defined washing cycle whereby they let the machine decide on the correct amount of detergent etc. In other modes of the machine the user may manually select the washing parameters such as water temperature, wash time, amount of detergent, vigorousness (e.g., heavy duty) of wash and water level.

The pre-wash phase function of the invention can be considered a 'sensing phase' where wash parameters can be automatically determined without input from the user.

The motor will typically be comprised of a stator and rotor assembly. A motor, particularly a direct-drive motor, is typically mounted to the underside/outside of the water container's base/end wall which is opposite to an access opening (lid/door) of the machine.

The load size detection system detects the size (preferably, the mass or weight) of the laundry load prior to commencement of the water fill. This may be achieve, for example, by a sensor configured to assist in determining a load size by weight or equivalent measurement or, in one form, the controller can be configured as a means of detecting load size by monitoring energy use or torque/force measurement during operation. Load size detection may be performed, for example, by accelerating the load in the spin tub from a low rotational speed to a higher rotational speed and determining the amount of energy that was required by the motor to achieve this. The required amount of energy correlates to load size. Alternatively, as mentioned previously, the torque required by the motor to achieve and maintain a predetermined rotational speed may be correlated to the load size. However, according to the present invention, all that is required is that some form of load-size detector and/or detection means/system is provided such that an indication of the load size can be obtained by the controller. However, it should be appreciated that the specific load size detection system or algorithm itself is not an essential part of the present invention.

Preferably, the first amount of water corresponds to being an amount sufficient to completely wet the load, but less than a second amount of water required to wash the detected load size.

Preferably, the first amount of detergent is a lesser amount than the second amount of detergent required to wash the detected load size. In practice the first amount is sufficient to loosen the soil but it not sufficient for effectively washing that detected load size.

Preferably, the limited duration of moving the load, e.g. by agitation/tumbling, is significantly less than that needed for effective washing of the detected load. The brief period of time for this gentle initial agitation or first tumbling stage, may be, for example, about 60 seconds. Preferably movement of the load for the limited duration is at a low speed, such that not too much soil is washed out of the load, but resulting in a mix of detergent, soil and water that provides a particular reduced water clarity (compared to clean water).

A water clarity sensor is a general term for a device for measuring water quality or purity, which is inversely related to the soil level. That is, greater clarity tends to infer less soiling. Preferably, the water clarity sensor is an optical sensor such as a turbidity sensor. Also preferably, the first water clarity measurement, performed after the first short tumbling/agitation stage of the water fill, establishes a turbidity baseline from when the laundry load is completely wetted but before the wash cycle commences. Preferably, a pause is provided after tumbling/agitation and before the reading is taken to allow bubbles/foam to dissipate. Such occurrences, if not allowed to dissipate, artificially increase the turbidity measurement by reducing light transmission to the sensor.

Preferably, the second amount of water is added concurrently with gentle movement of the load. A low speed/gentle agitation/tumble ensures the load is fully wetted, but at a speed that will not wash too much soil out of the load, until the required wash volume of water is reached for the detected load size. In other words the sum of the second amount of water and the first/existing amount of water in the enclosure is substantially equal to the total water volume required for washing that detected load size, according to a look-up table or other, established methods.

Gentle movement during ingress of the second amount of water may or may not comprise part of the second limited duration of agitation/tumbling. The second limited duration of movement, for example, for about 60 seconds, releases a controlled amount of soil from the load for mixing with the detergent and water, resulting in a probable change to the water clarity.

According to the invention a difference between two liquid clarity readings is calculated, rather than a single absolute value. This is necessary because clarity varies due to water hardness, scrud build-up in the outer tub, water temperature, detergent type, soil type etc. Therefore, the present invention suggests a change in turbidity is indicative of the amount of soil in the load, independent of those other factors. In order to estimate this consistently (for different load sizes, soil types, fabric types etc.) it is preferable to control the amount of detergent, water temperature, water volume (for various load sizes), and vigorousness/duration of the agitation/tumbling during the sensing phase so as to completely wet the load to enable all of the load's soil to be sampled but not to release excessive soil from the load (that is, not to start washing the load).

Preferably, a laundry machine includes a temperature sensor for measuring a water temperature within the enclosure. The controller can be configured to take a temperature measured by the temperature sensor and adapt/calibrate the turbidity measurements, however, preferably the initial fill water is taken from a cold supply and heated to a desired temperature, for example, 20° C. using a heating element, so that the turbidity measurements taken can be reliably compared to experimentally-obtained turbidity values taken under the same conditions.

Preferably, a consistent soil release occurs across all load sizes, soil types and fabric types so that the soil level for any load can be accurately determined using only two turbidity measurements. Water temperature affects how much soil is released from the load in a predetermined time period, that is, if the water is warmer then more soil will be released, increasing the liquid clarity reading compared to the same load in colder water. The amount of detergent will also affect how much soil is released from the load and how much foam is in the water (affecting liquid clarity readings as mentioned above). The amount of water for a detected load size is important so that soil is not diluted in the water volume—that is, for the same soil quantity, an increase in water volume will increase the liquid clarity reading as the liquid will become clearer. As mentioned above, if it can be ensured that the ratio of detergent/water is the same for all load sizes, then it is possible to accurately detect the soil levels for all load sizes for reliable comparison with experimentally-obtained values.

Preferably, a water level sensor such as a pressure sensor is also provided. As such, the machine is preferably initially filled to greater than about 75% (preferably about 90%) of a required wash liquid volume based on load size using the pressure sensor as a proxy for monitoring achievement of desired wash liquid volumes. The remaining about 10% of the required water volume is preferably filled by 'absorption' (explained below) to ensure accurate water volumes across all load sizes.

The soil level of the laundry load is preferably determined with the use of a turbidity sensor (which operates by passing light through the water to detect its clarity thereby indicating how much soil/detergent is in it) in the water container. The laundry washing machine preferably has an auto-dosing detergent dispensing mechanism (for example, a bulk detergent reservoir with a metering system to dispense a required amount of detergent to the water container). Usually the reservoir is filled with a liquid detergent because it may be simply metered and dispensed although conceivably, solid, such as powdered, detergents could equally be stored and dispensed. The system of the invention is operable in either top- or front-loading washing machines.

In contrast to JP04067896A, mentioned in the background to the invention above, the present invention involves initially adding a small amount of detergent just to get soil to release and then, in a further step, topping up the detergent based on the determined turbidity/clarity change (the turbidity/clarity change indicating soil level). This sensing phase happens before washing starts. The turbidity change is used to predict the soil level before (or by the time) washing starts and determines, for example, the amount of detergent required and/or the wash cycle duration necessary to wash the load.

In contrast to EP0454826A, the present invention involves estimating the load's soil level prior to washing the load (in an initial water filling period) so that the wash parameters such as cycle time and vigorousness can be set at the start, rather than extending/altering the washing time/vigorousness if the load is found, during washing, to have a soil level that exceeds a certain threshold.

Unlike U.S. Pat. No. 4,222,250A the present invention involves detecting a turbidity change, predicting the level of soiling, and setting wash parameters during filling, which occurs before washing starts.

As noted previously, it is known in the prior art to use a turbidity sensor to detect when the water clarity has improved to a level that signals that a washing cycle should end, however, the present invention involves determining a turbidity change during water filling, before washing commences, to automatically set appropriate wash parameters(s) for that load (subject to size and soil level). The invention potentially: minimises/optimises detergent use (or better matches the quantity of detergent to the soil level and load size), minimises/optimises the wash cycle time, and minimises/optimises energy use and/or minimises/optimises wear on the clothing load.

BRIEF DESCRIPTION OF THE DRAWINGS

Preferred embodiments of the invention will now be described by way of example only and with reference to the accompanying drawings, in which.

DETAILED DESCRIPTION OF EMBODIMENT

Figure 1:
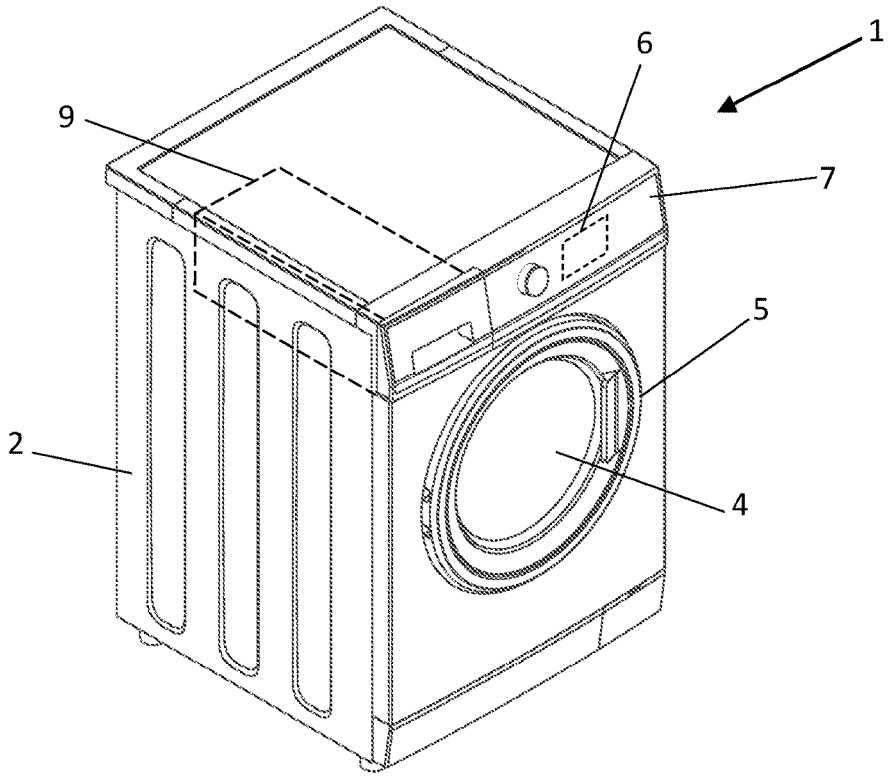
FIG. 1 is a perspective view of a front-loading laundry washing machine incorporating the soil-level determining system according to the present invention.
Figure 2:
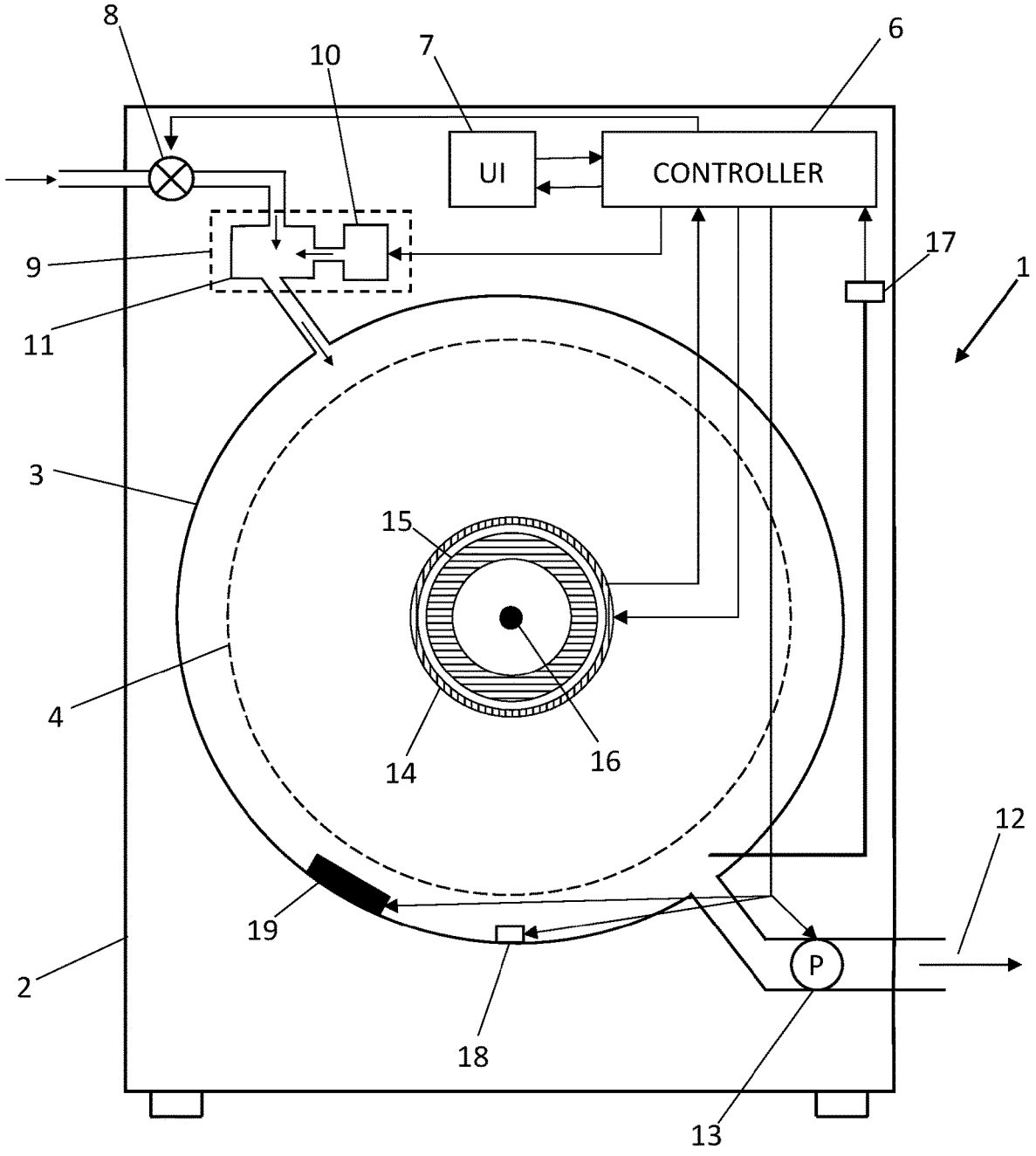
FIG. 2 is a schematic view of the laundry washing machine of FIG. 1.

A laundry washing machine 1 such as that shown in FIGS. 1 and 2, as is well known, includes an outer cabinet or "wrapper" 2 mounted within which, by a suitable suspension system (not shown), is a generally cylindrical, fixed (non-rotating) outer tub 3 for containing washing liquid. Within the outer tub 3 a generally cylindrical, rotatable perforated drum or spin tub 4 is mounted for holding a load of laundry, such as clothing, for washing. Access to the drum for loading and unloading the drum 4, in the case of a front-loading laundry machine, is via a door 5 mounted to cabinet 2. The outer tub 3 may be formed from a plastics material and, in the case of a front-loading laundry washing machine as shown, the outer tub may be formed in two axially separate halves which are subsequently sealed together about the drum. Although FIG. 1 illustrates a front-loading (or "horizontal axis") laundry washing machine, it should be understood that the soil level determining system of the present invention is equally applicable to other forms of laundry washing machine, such as top-loading (or vertical-axis washing machines).

During operation of machine 1, a controller 6 receives input from a user interface ("UI") or control panel 7 or, although not shown, via a wirelessly-connected electronic device such as a "smart" mobile telephone or tablet device executing an applications program enabling the user to interact with controller 6. The user may, via interaction with the controller, be able to select certain wash cycles and to set certain wash parameters such as the level of soiling of the wash load, water temperature, vigouressness/gentleness of washing action, as is well-known. The user may also provide an indication of the size (such as the mass/weight) of the laundry load or, alternatively, the machine may incorporate a known automatic load-sensing function. For example, the load may be rotated in the drum at one or more predetermined rotational speeds and motor parameters such as required torque (to reach/maintain the predetermined speed(s)) may be measured and used to estimate the size of the laundry load. In another example, one or more load sensor could be incorporated into the machine design, between cabinet 2 and water container 3, providing laundry load size (weight/mass) information to controller 6.

During a washing cycle water is provided to the drum via a water inlet valve 8, under instruction of controller 6, usually via a detergent dispenser 9 to allow a user to add detergent or other wash additives to water container 3 in the known way. The laundry washing machine according to the preferred form of the present invention however incorporates a detergent reservoir or storage chamber 10 that is preferably accessible for refilling by the user by sliding out a detergent drawer as in conventional front-loading laundry washing machines. A pump (not shown) within detergent dispenser 9 is activated by controller 6 to dispense a metered dose of detergent from reservoir 10 into a mixing chamber 11 where it is mixed with water and flows into water container 3. The pump may dispense a single metered detergent dose in accordance with the instruction from controller 6 or it could alternatively dispense multiple metered doses that in combination achieve the dose requested by controller 6.

As is well known, controller 6 may incorporate a microprocessor and associated memory for storing executable instructions in the form of a computer programme controlling operation of the laundry washing machine. At the end of a washing cycle (and optionally, at a predetermined stage or stages during the washing cycle) wash liquid exits the machine via outlet 12 when drain pump 13 is operated, again under instruction of controller 6. Although not shown in FIG. 2, a recirculation path for washing liquid may be provided from drain pump 13 back into water container 3 with a suitable valve provided to enable selection of recirculating or draining, as instructed by controller 6.

Controller 6 is also connected to control the operation of an electric motor, for example a Brushless DC ("BLDC") Permanent Magnet motor having a rotor 14 and stator 15. Although FIG. 2 schematically illustrates the motor as an "inside-out" variety with a permanent magnet ring of the rotor radially outside outwardly radially-extending poles of the stator, it could instead have an internal permanent magnet rotor and radially inwardly-directed stator poles. Rotor 14 may be directly attached to or mounted on a shaft 16 fixed to drum 4 on the drum's rotational axis so that the rotor fixedly rotates with the drum. In this case it is usual for the stator to be mounted to the outer side of a base or end wall of water container 3, opposite to door 6, with shaft 16 (and attached rotor 14) supported by at least one (usually at least two) roller bearing in the water container base. The electric motor could alternatively be mounted within cabinet 2 away from shaft 16 with a belt or chain rotationally connecting the motor's shaft and drum shaft 16. Controller 6 is also connected to receive a signal representative of the clarity of the washing liquid in water container 3 via a turbidity or clarity sensor 17.

As is well known, turbidity sensor 17 may, for example, transmit light through some of the liquid in the water container and its output signal is representative of the effect that the liquid's clarity has on that transmitted light. A pressure sensor 18, in the known way, provides controller 6 with a pressure signal indicative of the height of water (that is, the fill level) in water container 3. For example, pressure sensor 18 may include a diaphragm which flexes with pressure due to the quantity of water in the water container, the diaphragm moving a ferrite core within an inductor, the inductor forming part of a resonant circuit whose resonant frequency thereby changes with pressure. Such a pressure sensor generates an output frequency signal which is representative of the level of water within the outer tub. Controller 6 may also be coupled to a heating element 19 in the known way for raising the temperature (as sensed by a temperature sensor—not shown) of the water within the water container.

As summarised earlier, an important aspect of the invention is the provision of a load soil-level sensing phase before, or at the very start of, a washing cycle of the laundry washing machine's operation. The soil-level sensing phase enables the triggering of automatic wash-related functions based on a load size for use in a/the subsequent washing cycle. The soil-level sensing phase of the machine's operation occurs during the water filling period, after which the true "washing" part of the machine's operation commences and therefore the soil-level sensing phase may be considered to be carried out prior to washing commencing, or if the filling period is considered to be part of the actual washing phase, then the soil-level sensing phase may be said to be at the very start of the washing cycle.

Figure 3:
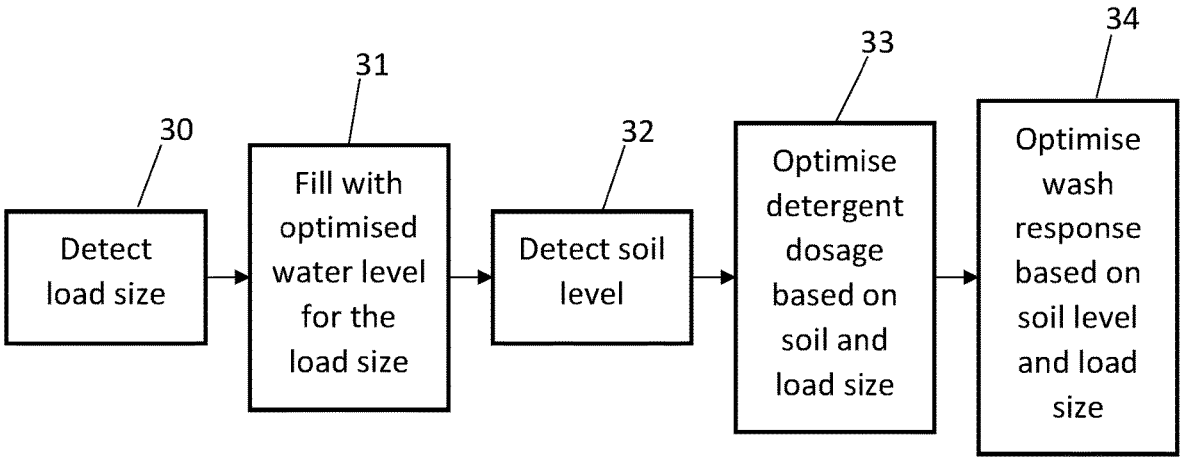
FIG. 3 is a high-level flow diagram of control system steps according to the soil-level determining system of an embodiment of the present invention.

A high level representation of control steps carried out by controller 6 is outlined in FIG. 3. For example, firstly the process involves detecting a load size (e.g., mass/weight) at step 30, followed by water filling step 31 dependent on the detected load from step 30. A load soil level is detected at step 32 (preferably soil level detection is achieved after a desired water level is achieved although soil level detection may commence before filling is completed) followed by a calculation of optimised detergent dosage at step 33 and an optimised wash response at step 34; based on load size and soil-level as determined at steps 30 and 32 respectively.

The sensing phase of the invention uses the turbidity sensor 17 to assist in making a determination of the amount of soil in a load before, or at the beginning of, the washing cycle. The sensing phase is outlined in FIGS. 4A and 4B (collectively "FIG. 4"). According to FIG. 4, firstly a load size is detected at step 30 (in common with FIG. 3), followed by an initial dose of a minimal amount of detergent at step 35. As previously mentioned, the method of determining or estimating load size is not critical to the performance of the present invention and there are multiple suitable known laundry load size detection methods in the art. By way of example, an initial detergent dose, relative to detected load size, can be determined with a look-up table such as Table 1 below. Naturally, the larger the load size, the more soil will ordinarily be present in the load so the higher the initial detergent dose will be. Also, as the load size increases the amount of water required to effectively wash that load will increase, and this will tend to dilute the added detergent.

TABLE 1

| | Light detergent dosage (g) | | | | | | | | | | | |
|---|---|---|---|---|---|---|---|---|---|---|---|---|
| Soil | Load Size (kg) | | | | | | | | | | | |
| level | 1 | 2 | 3 | 4 | 5 | 6 | 7 | 8 | 9 | 10 | 11 | 12 |
| Light | 17 | 22 | 27 | 33 | 38 | 43 | 48 | 54 | 59 | 64 | 70 | 75 |

$Y = 5.3x + 11.5$ (where x = measured weight value, Y = target detergent dose)

Initial detergent dosing with a wetted load is intended to encourage some soil to release from the clothes before taking a first water clarity reading. Accordingly, the initial detergent dosage values in Table 1 have been obtained, through experimentation, to result in a substantially constant detergent concentration, irrespective of load size (and its corresponding water fill volume) so that the released amount of soil (and its impact on the turbidity of the washing liquid) is representative of the degree of soiling (that is, the "dirtiness" or "cleanliness") of the load.

Table 1 shows the preferred quantities (in grams) of the initial detergent dose dispensed for various load sizes in 1 kg increments. The table could of course cater to a larger or smaller number of detergent dosage values, for example, in increments of 0.5 kg, or could alternatively be replaced by a mathematical function whereby input of a soil level results in the output of an initial detergent does volume. As mentioned above, the present system estimates the soil level of the clothes load and the detected soil level may be on a continuous scale or may be a quantised level selected from a set as is described below. In the following description the soil level may be one of 'light', 'normal' or 'high' (see Table 4 below, for example), although more or fewer levels could of course be used.

It will be noted that Table 1 lists detergent levels for various load sizes having only a 'light' soil level. At this early stage of the process the soil level has not yet been established. Accordingly, the initial amount of detergent added to the clothes load is the amount that has been predetermined as necessary for effectively washing a lightly soiled clothes load, irrespective of whether that load is subsequently judged to have a 'normal' or 'heavy' soil level. In this way, if it is subsequently determined that the soil level of the clothes load is 'light', then no additional detergent adding step need be carried out. If the soil level is instead subsequently determined to be greater than 'light' (for example, 'normal' or 'heavy') then an additional amount of detergent may be added to the clothes load so that the total volume or weight of detergent added corresponds to the amount that has been determined as necessary for the particular soil level and load size.

Figure 4A:
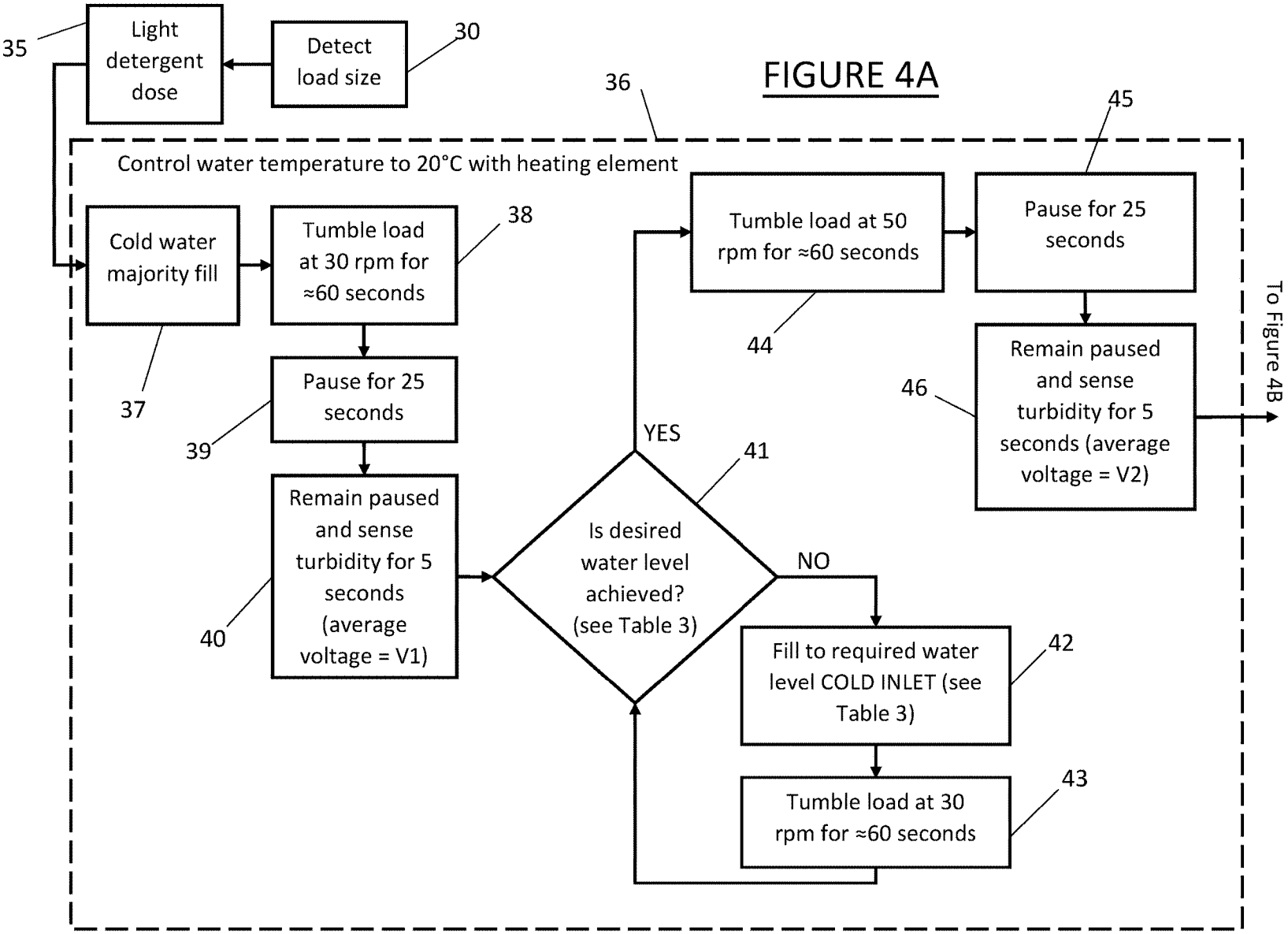
FIGS. 4A and 4B together are a detailed flow diagram of a sensing phase, at the beginning of, or before, a wash cycle of the laundry washing machine of FIG. 1, for detecting soil level in a load and setting wash parameters in response.

According to FIG. 4 and, particularly, the section of steps enclosed by a dotted box 36 in FIG. 4A, it is preferable to fill water container 3 with water from a cold supply and raise this to 20° C. with the heating element 19. This is because water temperature affects soil release from the load and changing water temperature adds a further degree of freedom or uncertainty to the soil-level analysis. Accordingly, the preferred form of the present invention maintains the water temperature at a predetermined value (for example, 20° C.) so that resulting turbidity values can be compared to experimentally obtained values and accurate inferences made of the load's soil level therefrom.

At step 37 a majority of the required water volume for the detected load size is filled into the washing machine's water container via cold water inlet valve 8 along with the initial, 'light' amount of detergent (dependent on load size) from step 35. For example, at step 37 greater than about 75%, preferably about 90%, of the amount/volume estimated as required to effectively wash the detected load size is admitted to the water container. An example of this "majority" fill level based on detected load size is provided by Table 2 below.

TABLE 2

| Majority fill level—Aiming for 90% fill | | | | | | | | | | | | |
|---|---|---|---|---|---|---|---|---|---|---|---|---|
| Majority | Load Size (kg) | | | | | | | | | | | |
| fill | 1 | 2 | 3 | 4 | 5 | 6 | 7 | 8 | 9 | 10 | 11 | 12 |
| Fill Level | 3969 | 3949 | 3923 | 3900 | 3877 | 3854 | 3830 | 3807 | 3784 | 3761 | 3738 | 3715 |

Equation for target water level count Y = −23.15x + 3992.5 (where x = Measured weight value, Y = Water level target)

As mentioned above, the pressure sensor may output a signal whose frequency is indicative of water level. The "Fill level" values in the above table are not raw frequency values but are instead values calculated based upon the detected frequency of the pressure level sensor output signal and are representative of water level. It should be noted that as the water level in the outer tub increases, the frequency of the pressure sensor's output signal decreases and so smaller "Fill level" values indicate a greater actual water level within the outer tub.

As also previously mentioned, a light dose of detergent is added to the wetted load to loosen some soil when, following the majority fill, subjected to brief tumbling/agitating action, for example the drum is rotated for about 60 seconds at 30 rpm with a tumble pattern of, for example, 30 seconds in a first rotational direction, 5 seconds pause, and 30 seconds in the opposite rotational direction (that is, a "30, 5, 30" tumble pattern) at step 38. A first turbidity reading of the liquid in the water container is then taken at step 40 after a pause of, for example, 25 seconds at step 39. The first tumble stage 38 ensures that all of the clothes are wetted and at least some soil (a controlled amount of soil) releases from the clothes load before the first turbidity reading is taken, but the speed is low enough that not too much soil is washed out of the load and mixed with the detergent and water. Preferably, the pause at step 39 is provided before the reading is taken to allow bubbles/foam to dissipate because they artificially increase the turbidity reading by reducing light transmission to the light sensor of the turbidity sensor.

This first turbidity or clarity reading at step 40 provides a baseline wash liquid turbidity value for a completely wetted load. Preferably rotation of the drum remains paused in step 40 while turbidity is measured over a short interval of time, for example 5 seconds. The first turbidity reading V1 is preferably an average voltage of the output of the turbidity sensor over that short period of time.

It is noteworthy that Table 2 shows that the required "majority fill" water level (as detected by pressure sensor 18) decreases as load size increases and this is in agreement with the above comment that the "Fill level" values in the table correspond to the frequency of the pressure sensor output signal which has an inverse relationship to water level. However, as explained in more detail below, the relationship of water volume (which is the water parameter of importance in ensuring an adequate wash for any given load size) to sensed water level is not straightforward. Although a larger load size will have a higher water level than a smaller load size, some of the added water volume will be held within the clothes load, out of the water pool being sensed by pressure sensor 18. The approach of the invention is to try to have the same detergent to water concentration for all load sizes, because the detergent concentration will affect the turbidity reading, so that the soil level can be more accurately detected.

Returning to FIG. 4, step 41 requires a determination of whether a desired water level, corresponding to the volume of water that is estimated as required for the sensed load size, has been achieved. A look up table is consulted, for example, as outlined by Table 3 below which is again specified in terms of the output signal of pressure sensor 18.

TABLE 3

| Desired Fill level (following initial 90% majority fill) | | | | | | | | | | | | |
|---|---|---|---|---|---|---|---|---|---|---|---|---|
| Desired | Load Size (kg) | | | | | | | | | | | |
| fill level | 1 | 2 | 3 | 4 | 5 | 6 | 7 | 8 | 9 | 10 | 11 | 12 |
| Fill Level | 4010 | 4010 | 4010 | 4010 | 4010 | 4010 | 4010 | 4010 | 4010 | 4010 | 4010 | 4010 |

Assuming the required level is not yet met, more water is required and the process continues to step 42 where additional water is added to the load while the water temperature is maintained at the predetermined temperature (such as 20° C.). We term this additional water fill process an "absorption fill" and it is carried out while the load is very gently tumbled/agitated at step 43 simply to ensure that the load is fully wetted and all soil on every item within the load is wetted by the detergent solution. Again, this is carried out at a rotational speed that will not wash an excessive amount of soil out of the load—the aim is to only release a detectable amount of soil that is representative of the general level of soiling of the load. Accordingly, the drum may again be rotated at a rotational speed of around 30 rpm for about 60 seconds with, for example, a 30, 5, 30 tumble pattern. Although the exemplary entries in table 3 are the same for all load sizes this need not be the case and does not indicate that the same water volume is added to all load sizes because a larger load size will retain more washing liquid within it (some of which will be out of the washing liquid pool sensed by the pressure sensor) than a smaller load size.

When a further amount of water has been added so that the required volume of water has been achieved for that load size (as estimated by the output of pressure sensor 18 reaching the appropriate value), the process may progress from decision block 41 to step 44 where the load is then tumbled/agitated for a predetermined period (for example, about 60 seconds) to release a controlled amount of soil from the load and to mix the soil, detergent and water. This tumbling may be at a higher rotational speed than used in steps 38 and/or 43 but its limited duration ensures that only a controlled amount of soil is released from the load and again, for example, the tumble pattern may be 30, 5, 30. A second turbidity reading of the liquid in the water container is then taken at step 46 with turbidity sensor 17, after a pause of, for example, 25 seconds at step 45. Again, the pause step 45 is preferred before taking the second reading to improve accuracy. The second turbidity value V2 is preferably an average, over a short period of time such as 5 seconds, of the output voltage signal of the turbidity sensor.

Outside of the temperature-controlled conditions of box 36 (see FIG. 4A), controller 6 calculates a difference between the two turbidity readings, V3=V1-V2, at step 47. This change in turbidity is indicative of the amount of soil in the load and, in order to estimate this consistently for different load sizes, soil types, fabric types etc., it is necessary to control the amount of detergent, water temperature, water volume (for various load sizes), and vigorousness/duration of the tumbling during the sensing phase so as to completely wet the load to enable all of the soil to be sensed but not to release an excessive amount of soil. By calculating the difference between two turbidity readings it is anticipated that it may not be necessary to continually re-calibrate turbidity sensor 17 (that is, to reset its output level over time to account for aging or contamination of its components).

At step 48 the controller considers options dependent on the turbidity change from the first to second reading. If V3 is less than a first predetermined difference value, for example, 0.33 Volts (that is, only a small difference between the first and second turbidity readings) then controller 6 commences a washing cycle (for example, an 'Everyday' washing cycle) at step 49 with the load's determined soil level set to 'Light'. The wash parameters of the washing cycle are then customised to the determined load soil level so that, as shown for example in FIG. 4, the amount of detergent added to the wash may be modified based upon detected soil level and detected load size. However, in the case of a 'Light' soil level, it will be recalled that the initial detergent dose added in step 35 corresponded to a lightly soiled load and so no additional detergent will be added. Another wash parameter that may be modified based upon the detected soil level is the duration of the wash cycle and exemplary wash times, in minutes, are set out in Table 5 for the various soil levels and load sizes.

Alternatively, at step 50 if V3 is greater than a second predetermined value, for example 0.6 Volts (i.e., a larger difference between the first and second turbidity readings) then the load is considered to be heavily soiled and a second 'Heavy' dose of detergent is applied according to step 51. The amount of the second detergent dose can be determined from a look up table, for example, the additional dosages set out in the 'Heavy' row of Table 4. A wash cycle is then commenced (for example, an 'Everyday" cycle) with wash parameters modified to correspond to settings determined for 'Heavy' soiling. For example, the wash cycle duration may also be modified based upon the determined soil level at step 52, with a wash time duration determined by the look up table values in the 'Heavy' row of Table 5, dependent upon the determined load size.

TABLE 4

| Extra detergent dosage (g) | | | | | | | | | | | | |
|---|---|---|---|---|---|---|---|---|---|---|---|---|
| Soil | Load Size (kg) | | | | | | | | | | | |
| Level | 1 | 2 | 3 | 4 | 5 | 6 | 7 | 8 | 9 | 10 | 11 | 12 |
| Normal | 5 | 8 | 10 | 12 | 15 | 17 | 20 | 22 | 24 | 27 | 29 | 31 |
| Heavy | 19 | 22 | 26 | 29 | 33 | 36 | 40 | 43 | 47 | 50 | 53 | 57 |

Normal: $Y = 2.3776x + 2.879$ (where x = measured weight value, Y = target detergent dose)
Heavy: $Y = 3.4441x + 15.53$ (where x = measured weight value, Y = target detergent dose)

At step 50, if the V3 value is found to be between the first and second predetermined values, for example between 0.33 Volts and 0.6 Volts, then the process moves to step 53 where a second 'Normal' dose of detergent is applied to the water container. This is less than the 'Heavy' dose from step 51, but the level of soiling detected indicates that a second dose is still required beyond the initial dose at step 35. The additional amount of detergent can be determined from a look up table, for example the 'Normal' row of Table 4 above. It will be noted that the detergent quantities in the 'Normal' and 'Heavy' rows of Table 4 are lower than the amounts for the 'Light' soil level of Table 1. This is because the Table 4 values are additional detergent quantities beyond the quantity already dispensed at step 35. It should therefore be appreciated that the initial or 'Light' soil level detergent dose for a 7 kg load size, for example, is 48 g whereas the 'Normal' soil level detergent dose for a 7 kg load size is 68 g (48 g+20 g) and the 'Heavy' soil level detergent dose for a 7 kg load size is 88 g (48 g+40 g). At subsequent step 54 the wash cycle (for example, an 'Everyday' cycle) is commenced with additional wash parameters modified in accordance with the detected soil level. For example, the duration of the wash cycle is modified to correspond to 'normal' soil level duration settings determined from the 'Normal' row of Table 5.

TABLE 5

| Wash times (minutes)—everyday cycle 40° C. | | | | | | | | | | | | |
|---|---|---|---|---|---|---|---|---|---|---|---|---|
| Soil | Load Size (kg) | | | | | | | | | | | |
| Level | 1 | 2 | 3 | 4 | 5 | 6 | 7 | 8 | 9 | 10 | 11 | 12 |
| Light | 9 | 10 | 12 | 13 | 15 | 16 | 17 | 18 | 19 | 20 | 20 | 21 |
| Normal | 19 | 21 | 22 | 23 | 24 | 25 | 25 | 25 | 26 | 26 | 26 | 26 |
| Heavy | 24 | 25 | 27 | 28 | 30 | 31 | 32 | 33 | 34 | 35 | 35 | 36 |

Light: $Y = -0.0574x^2 + 1.8307x + 7.0455$ (where x = measured weight value, Y = wash time target)
Normal: $Y = -0.1011x^2 + 1.787x + 17.614$ (where x = measured weight value, Y = wash time target)
Heavy: $Y = -0.0574x^2 + 1.8307x + 22.045$ (where x = measured weight value, Y = wash time target)

The applied soil level sensing method as described above should result in a consistent soil release across all load sizes, soil types and fabric types so that the soiling level for any load can be accurately determined using only two turbidity readings taken just after the user starts the machine to wash a load (that is, just before the washing cycle commences or at the very start of the washing cycle if the water fill phase is considered part of the washing cycle). The present soil level sensing system does not add significantly to the total duration of the washing cycle.

The system described above introduces the concepts of "majority fill" and "absorption fill" and these terms will now be further described. Conventionally, a laundry washer is set to achieve a certain water level (as detected by the pressure sensor 18) by "absorption filling" whereby water is added and the clothes are gently tumbled/agitated so that the water fully soaks the load. As the water soaks into (or is absorbed by) the load, the level sensed by the pressure sensor 18 drops (frequency increases) and more water is added until the pressure sensor detects the required level. This is a relatively slow, iterative process. In order to speed up the water filling required in the sensing phase 16 (and so to avoid too much soil being washed out of the load during the sensing phase), experiments were carried out on a number of 'Standards' loads and the volumes of water required for various load sizes were measured using a flow sensor and recorded.

Preferably the initial volume of water added at step 37 (before the first turbidity reading is taken) is called the majority fill and it is a major proportion (for example, greater than about 75% such as about 90%) of the amount or volume of water that has experimentally been determined as being required for sufficiently wetting and washing that load size. However, because laundry washing machines use pressure sensors to determine water level rather than flow sensors to determine volume, further experiments were carried out to determine corresponding pressure sensor readings (that is, water levels) to the majority fill (90% of required water volume) values with the drum also containing different 'Standards' load sizes. Those experimentally determined pressure sensor readings are set out in Tables 2 and 3.

An exemplary value of 90% (rather than a higher value) was chosen because different fabric types will absorb water to different extents—for example, a 5 kg load of delicate clothing requires less water than a 5 kg load of towels to achieve a desired water level because the towels will absorb more water and hold some of it out of the sensed water pool. Accordingly, to avoid subsequent overfilling for delicate loads (when additional water is later added to finish the water fill in step 42) it is desirable to only fill initially to about 90% of the estimated volume required.

Before the second tumble/agitate is carried out for about 60 seconds (step 44), the water level is increased to the required water level for the particular load size (determined at steps 41, 42 and 43). The last, for example, about 10% of the required water volume for the detected load size is added by 'absorption filling' whereby the load is gently tumbled and water is added until the pressure sensor output reaches a value indicating that the water volume in the water tub (some of which has been absorbed by the load and may be out of the pool of water in the water tub), as registered by the pressure sensor 18, is now at the required volume (see Table 3) for that load size.

The absorption fill at step 42 is only adding the last approximately 10% of water volume (or less if the load is made up of material that does not absorb much water) so will be much faster than the majority fill at step 37. It should be appreciated that it is not essential that the volume of water added to the load is precisely 100% of the initially estimated required water volume for that load. The majority fill has already supplied around 90% of that water volume and then additional water is added until the pressure sensor 18 registers that the water level in the water container has reached a height that indicates that the amount of free water pooling in the water container, plus the amount of water retained by the load, is sufficient to effectively wash that particular clothes load.

The advantage of the method and system described herein is that the so-called 'intelligent' wash optimises wash time to achieve clean clothes in the most efficient way. In testing of 128 loads with differing actual soil levels and 128 loads of SBL 2004 test material (commercially available using sebum/oil-based soil and regarded as the closest to real soil found in clothing), compared to an existing "everyday" cycle (with a constant predetermined washing cycle duration for all soil levels), the intelligent wash cycle of the invention resulted in:

- for 63% of cycles, the cycle time was altered (57% of cycles were reduced in time, 6% were increased);
- for the 57% of cycles that had their duration reduced (compared to the everyday cycle duration), the cycle time was reduced by 5-30% while still achieving satisfactory cleaning of the load.

Detergent usage is also optimised, compared to a manufacturer's recommended dose for a "normal" load. Testing found that:

- for 99% of cycles, the amount of detergent dispensed by the 'intelligent' wash cycle method herein was not the manufacturer's recommended amount (60% of cycles had reduced detergent, 39% of cycles had increased detergent);
- for the 60% of cycles with reduced detergent, the quantity of detergent was reduced between 1-70% compared to the manufacturer's recommended dose for a "normal" load.

In terms of clothes care, the method of the invention ensures that the same soil removal target is achieved across all load sizes and soil levels of the load. The user's needs are therefore achieved in the most efficient and gentle way as the wash load is only washed as much as required to be adequately cleaned.

The invention may be implemented by further embodiments and modifications beyond that described above. For example, soiling can be categorised by multiple levels or be continuous rather than at three discrete levels as exemplified herein.

It will be noted that the above tables also include a best-fit function which could enable any detected load size to be input to the system and for any soil level to be detected rather than the quantised ones described. It will also be appreciated that, while not preferred, the above-described system could be implemented in a laundry washing machine that does not include an automatic detergent dispensing (or "detergent dosing") system. In such a case, the user would be instructed to add a specified amount of detergent prior to commencement of the sensing phase and then, once any additional amount of detergent has been determined to be necessary, the user would be instructed to add that amount of detergent. Still further, although the dispensing of detergent to the washing load during the sensing phase is beneficial in causing release of soil to the washing liquid, it would be possible to detect changes in washing liquid turbidity using the above process even without using detergent during the sensing phase.

It is also envisaged that the way in which various wash parameters vary with temperature could be investigated so that tables such as those shown above could also account for water temperatures other than 20° C. during the sensing phase. Filling could then be achieved with only 'cold' water (at whatever temperature the particular user's cold water system provides) or any other temperature of water that the washing machine could provide by mixing hot and cold water supplies or by utilising the washing machine's heating element 19 (where provided). This would enable the fill to be achieved at a temperature to match the temperature used in the subsequent washing cycle. For example, the washing cycles discussed above in relation to steps 49, 52 and 54 of FIG. 4 are at 40° C. so, in these cases, the sensing phase could be carried out with the majority fill water volume at 40° C. provided that the detergent dosage and wash durations obtained from the above tables also accounted for water temperature.

The present invention is also relevant to other forms of washing machine, such as dish washing machines, where the level of soiling of the dishes placed in the machine could be determined prior to commencing a wash programme.

Alternative Embodiment

An alternative embodiment of intelligent wash cycle sensing phase to that described above in relation to FIG. 4 will now be described with reference to FIG. 5. This alternative sensing phase embodiment shares many of the same steps as detailed above in relation to FIG. 4 and so the following description will concentrate only on the steps that are new or have changed in comparison to FIG. 4.

As with the FIG. 4 embodiment, the sensing phase commences with a load size determining step 60. At step 61 the water inlet valve(s) is/are opened and water (but no detergent) is added to the water container until the turbidity sensor is submerged. Because the location of the turbidity sensor is known, submergence of the turbidity sensor may be assumed once pressure sensor 17 detects a predetermined water level. Alternatively, the output of the turbidity sensor may be monitored and submergence detected when a substantial change in sudden or step change in turbidity occurs. The incoming water is preferably not directed at the laundry load and the turbidity sensor is located beneath the spin tub, so no soil is released into the wash liquid during this step. Controller 6 then obtains an initial turbidity reading, V1, via turbidity sensor 18 at step 62 which is indicative of the turbidity of "clean" water and any aging or contaminant build-up effects on the turbidity sensor. The initial turbidity value, V1, may be the average of the output voltage of turbidity sensor 18 over a short time period of, for example, 8 seconds. Then at step 63 an initial detergent amount is released from detergent dispenser 9. This initial detergent amount is based upon load size and may, for example, be set out in table form such as Table 1 (above), or more preferably, the amount (in ml) may be calculated by an equation such as:

$$\text{Detergent Initial Dosage}=5.3x+11.5,\ \text{where } x \text{ is the calculated load value in kg}$$

Figure 5A:
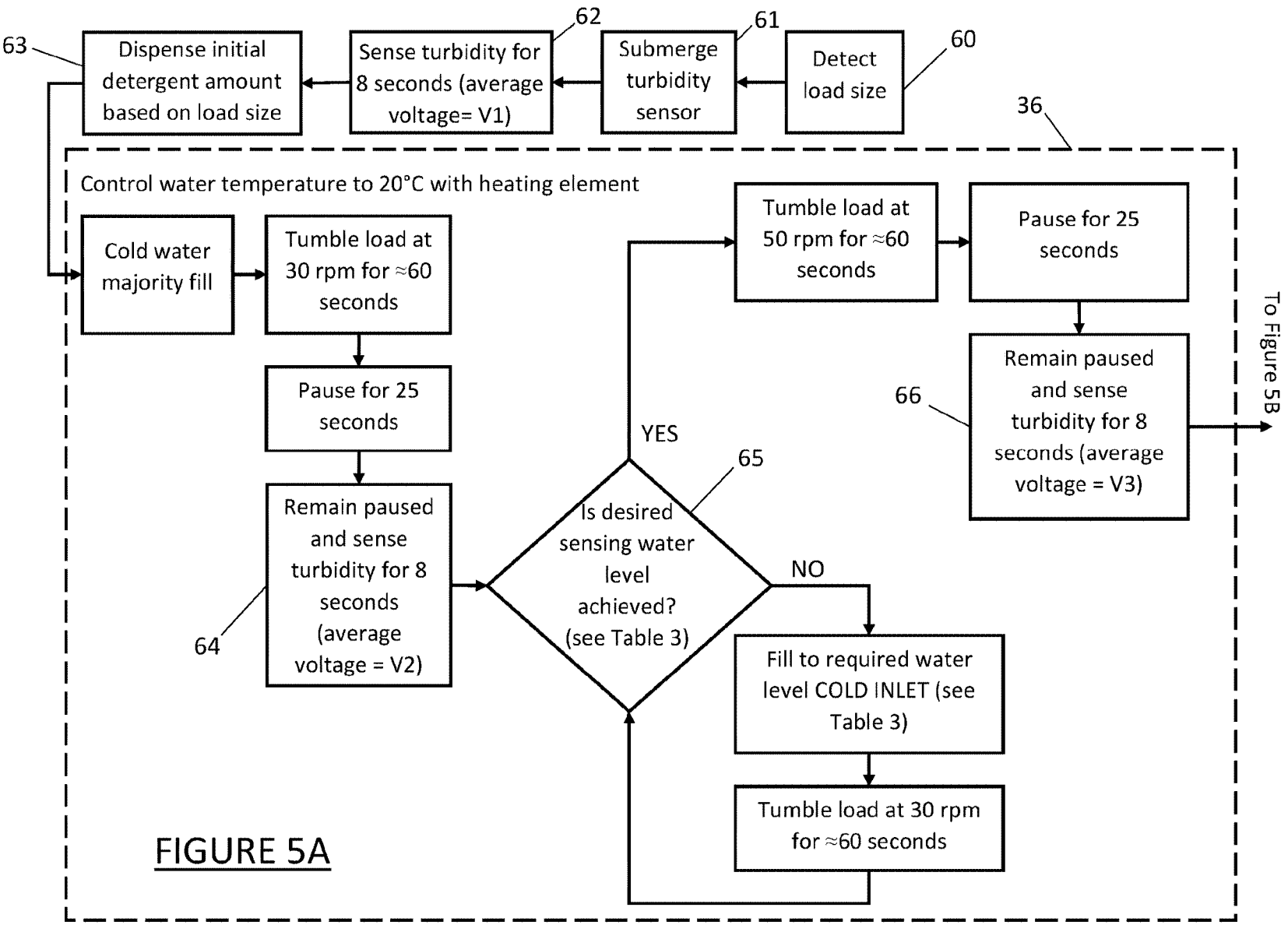
FIGS. 5A and 5B together are a detailed flow diagram of an alternative sensing phase embodiment to that illustrated in FIGS. 4A and 4B.

The remainder of FIG. 5A corresponds closely to FIG. 4A except that at step 64 (step 40 in FIG. 4A), a second turbidity reading is taken, preferably over a slightly longer duration of 8 seconds. This second turbidity reading, V2, corresponds to FIG. 4A's first turbidity reading (V1) and, as will be explained below, this turbidity reading is not essential in evaluating the soil level of the load in this alternative embodiment. Also, decision step 65 differs from FIG. 4A's step 41 in that the sensed water level is being compared to a "desired sensing water level" instead of the previous "desired water level". Despite this change in terminology, the "sensing water level" is preferably the level set out in Table 3 above and so may be a value that is dependent upon load size and preferably comprises a pressure sensor output value of 4010 for all load sizes. The remaining difference between FIGS. 4A and 5A is in decision step 66 (corresponding to step 46 in FIG. 4A) where, again, averaging of the turbidity sensor output signal may be carried out over a slightly longer period of 8 seconds, to obtain a third turbidity value, V3. Accordingly, by step 66 in FIG. 5A controller 6 is provided with three turbidity readings (V1, V2 and V3) which characterise the soil level of the wash load. Moving now to FIG. 5B, at step 70 an optional check is carried out to determine whether the turbidity sensor has failed or is incapacitated (such as if it has been contaminated by an excessive build-up of lime scale and/or wash residue). For example, the check at step 70 could consist of evaluating whether all of the turbidity readings (V1, V2 and V3) are within a predetermined acceptable operating range, such as between 0.5V and 4.7V. If one or more of the sensed outputs from turbidity sensor 18 are outside the predetermined range then the turbidity sensor is determined to be unreliable and the wash cycle progresses by defaulting to a "Normal" wash load soil level by following the dashed line from step 70.

If the result of the sensor check at step 70 is acceptable then at step 71 controller 6 calculates a value, ΔV, based upon the first and third turbidity readings (that is, two turbidity readings), which is indicative of the soil level of the laundry load as follows:

$$\Delta V=4(1-V3/V1)[\text{if } \Delta V<0 \text{then set } \Delta V=0]$$

In contrast to the difference voltage calculation at step 48 in the previous embodiment, the calculation at step 71 incorporates a ratio of the two turbidity values and so ΔV is a number rather than a voltage. Subsequently, ΔV is compared to various thresholds to decide the load's soil level and at least one wash parameter, such as detergent dosage. It is expected that the value V3 will be lower than value V1 because the output of the turbidity sensor will reduce with increasing turbidity. Accordingly, V3/V1 should be a positive number that is slightly less than one for small differences in turbidity. By dividing the turbidity values rather than taking their difference, then subtracting that ratio from 1 and multiplying the result by a scale factor (4 in this case), the ability to discriminate between soil levels is improved, particularly for soil levels that are close to a threshold value.

Figure 4B:
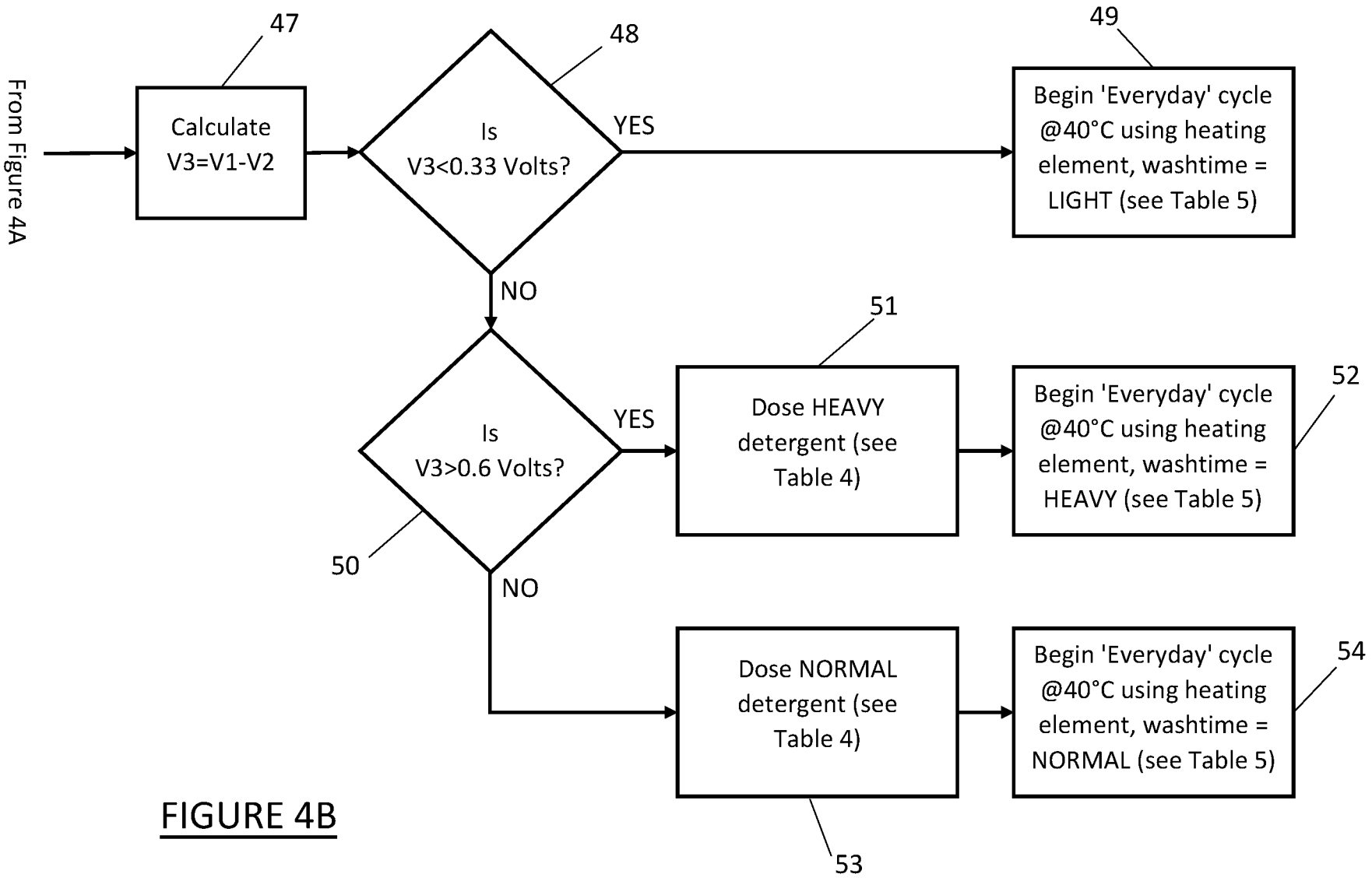
Figure 5B:
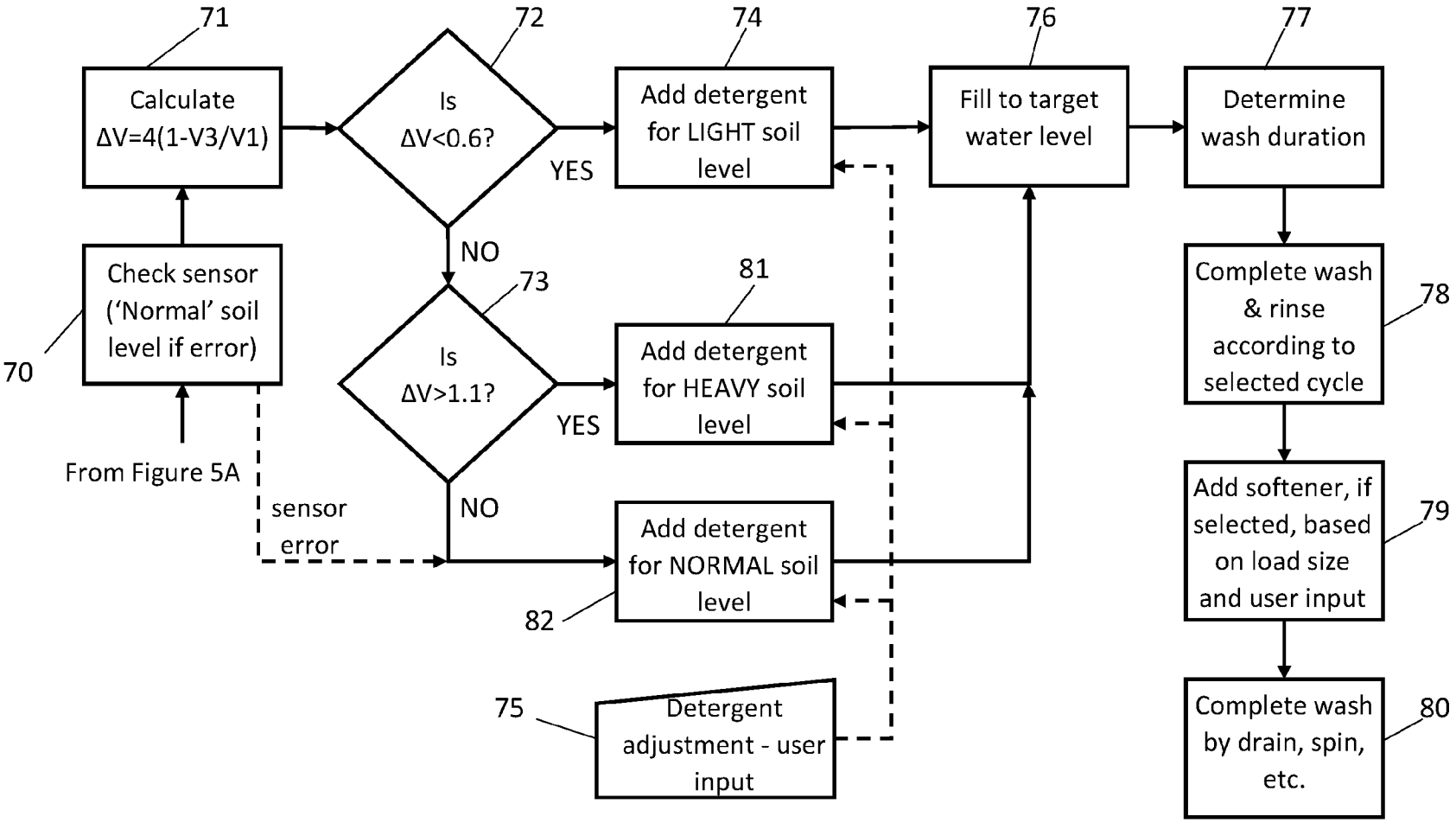

Decision steps 72 and 73 describe the threshold levels as 0.6 and 1.1 compared to the threshold levels of 0.33 and 0.6 in FIG. 4B. Accordingly, the calculation step 71 also provides a greater dynamic range for ΔV, further improving the ability to characterise the laundry load to an appropriate discrete soil level. It will be appreciated that, as before, fewer or additional threshold values could be included (for example, light/normal or normal/heavy) so that it is not essential that only three discrete soil levels are possible. Also, as previously mentioned, it should be appreciated that the second turbidity reading, V2, has been used in the optional error checking step but has not been used to determine wash parameters. As a result, in this alternative embodiment, although two separate controlled soil release operations are carried out (similar to steps 38 and 44 in FIG. 4A), these operations could be consolidated into a single controlled soil release operation during, or subsequent to, the majority fill phase so that this alternative embodiment also essentially includes the sensing of only two turbidity readings.

In the previously described embodiment, it was assumed that the wash cycle would be set to 'Everyday" for all soil levels and all load sizes. In this alternative embodiment, the user may select from a predetermined set of wash options such as 'Everyday', 'Cotton', 'Heavy', 'Delicate' and 'Sports', depending upon the type of clothing in the load and/or the user-perceived soiling level. Accordingly, even for laundry loads that have been determined to have a 'Light' soil level, depending upon the user-selected cycle, it may still be necessary to add an additional quantity of detergent to the wash load. Furthermore, it is also preferred that a user adjustment mechanism is provided to enable a user to modify the automated detergent amount dispensed according to the described process. That is, at step 75, a user is able to input to controller 6, via appropriate buttons on the user interface 7, an indication that the automated detergent dosage should be slightly increased or slightly decreased for any particular wash option. For example, after becoming familiar with the results of the intelligent wash process, the user may decide that they would prefer a little more or a little less detergent than the amount that has been automatically determined by the wash system. Preferably, the user is able to select from the following possibilities: 'Less-', 'Less', 'Normal', 'More' or 'More +'.

At decision step 72, a ΔV value below 0.6 indicates that the soil level of the load is 'Light' and at step 74 any necessary additional detergent (beyond that added at step 63) is dispensed to the wash load from detergent dispenser 9. The additional amount of detergent required for each lightly soiled load size may be set out in table form similar to Table 4 above. But preferably an equation is used to calculate the additional detergent amount based upon the load size and any user-input detergent dosage adjustment factor. As the wash system is designed to cater for a range of wash options, a different equation may be provided for each wash option setting. For example, the following equations may be used to determine the required additional detergent dose (in ml) for each wash option setting with a sensed 'Light" soil level, where x is the detected load size in kg:

$$\text{Everyday:Detergent Extra Dosage}=0.0699x^2-0.2238x+3$$

$$\text{Cotton:Detergent Extra Dosage}=0.1039x^2-2.1688x+16.136$$

$$\text{Heavy:Detergent Extra Dosage}=0.0649x^2-0.3686x+10.045$$

$$\text{Delicate:Detergent Extra Dosage}=-0.0202x^2+1.3574x+1.5227$$

$$\text{Sports:Detergent Extra Dosage}=0.1014x^2+2.3322x+1.1818$$

Once the Detergent Extra Dosage value is determined from the relevant above equation, that value may be modified based upon the user-input adjustment setting. Firstly, each of the possible adjustment input settings ('Adjustment value') is given a numerical value, such as:

'Less–'=0.8'Less'=0.9'Normal'=1'More'=1.1'More+'=1.2

Then a final calculation is made to determine the Final Dosage amount of detergent to dispense, which may for example be calculated by:

(Adjustment value*(Detergent Extra Dosage+Detergent Initial Dosage))−Detergent Initial Dosage As an example, for a load size calculated as 6.2 kg with a sensed 'Light' soil level on a 'Sports' wash option and a user adjustment of 'More +':

$$\text{Detergent Extra Dosage}=0.1014*(6.2)^2+2.3322*(6.2)+1.1818:=19.5\text{ ml}$$

$$\text{Final Dosage}=(1.2*(19.5+44.3))-44.3)=32.3\text{ ml}$$

Note that the value of 44.3 ml for Detergent Initial Dosage is calculated from the equation beneath Table 1 above and that any Final Dosage less than zero is ignored while a calculated Final Dosage greater than a predetermined upper limit, such as 150 ml, is capped at that predetermined upper limit.

If the decision at step 72 reveals that ΔV is not less than 0.6, at step 73 it is decided whether ΔV is greater than 1.1. If ΔV is greater than 1.1 then the laundry load is determined to have a 'Heavy' soil level and at step 81 any additional detergent is added based upon the soil level determination, the load size, the user-selected wash option and any user-selected adjustment in a similar fashion to that explained above in relation to step 74.

If, at step 73, it is determined that ΔV is not greater than 1.1 (but greater than or equal to 0.6) then the laundry load is determined to have a 'Normal' soil level and at step 82 any additional detergent is added based upon the soil level determination, the load size, the user-selected wash option and any user-selected adjustment in a similar fashion to that explained above in relation to step 74.

It will be recalled that decision step 65 resulted in the water container holding a volume of water best suited for producing a consistent detergent concentration such that turbidity value V3 may be accurately determined across a range of load sizes. Once any additional detergent has been dispensed at step 74, in some cases it may be advantageous to top up the volume of water within the water container at step 76. In particular, the respective wash option settings may have an associated target water level that has been experimentally determined to provide optimum wash results for a load having that particular cloth type and/or user-perceived level of soiling. For example, a 'Delicate' laundry load may have a target water level value of 3855 (that is, higher than the value of 4010 that has been achieved at step 65). Alternatively, certain wash option settings may not require additional water to be added at step 76, or the target water level following the addition of water at step 76 could be dependent upon the detected laundry load size.

At step 77 the duration of the wash cycle is determined, based upon detected load size, sensed soil level and the user-selected wash option setting. The range of wash durations may be provided in a look-up table but it is preferred that an equation be provided for each user-selectable wash option in each sensed soil level. For example, a laundry load having a 'Heavy' sensed soil level and a user-selected 'Cotton' wash setting may have a wash duration, in minutes, calculated by:

$$\text{Wash duration}=-0.5694x^2+13.046x+22.545,\text{ where } x=\text{the detected load size in kg}$$

Accordingly, in this scenario, a load size of 4.6 kg would have a wash duration of around 70.5 minutes. Once the wash duration has been determined, at step 78 the wash cycle is commenced with the drum rotating in alternate directions in the known way. At the completion of the wash cycle the wash liquid may be drained via pump 13 to outlet 12 and a volume of fresh water added to the water container. The laundry load may then be rinsed in the fresh water with wash parameters (duration, vigorousness, speed etc.) set according to the user-selected wash setting as is well known.

Within drawer 9, in addition to a user-fillable detergent compartment, a user-fillable bulk fabric softener compartment may also be provided. The fabric softener compartment, similar to the detergent compartment, may be provided with a metering device to release a predetermined dosage of fabric softener into the water container under control of software executed by controller 6. Once the rinse cycle in step 78 is completed and the wash liquid drained from the water container, fabric softener may be dispensed into the water container at step 79 and water added to the water container until the water level sensor indicates an appropriate water level. The fabric softener is then distributed through the laundry load by appropriate wash action of the drum. Addition of fabric softener at step 79 is optional and will only occur if the user has selected an appropriate option via user interface 7. The volume of fabric softener dispensed to the water container may be dependent upon the sensed load size and a look-up table or appropriate equation may be provided to controller 6 for this purpose. Similar to step 75, the user interface may be provided with a mechanism by which the user can manually adjust the automatically-determined fabric softener volumes based upon personal preference. For example, the user may select from: 'Less−', 'Less', 'Normal', 'More' or 'More +'. As with the user-adjustment to dispensed detergent volumes, each or the fabric softener adjustment options may be associated with a scaling factor that modifies the calculated (or looked-up) fabric softener volume. The wash is completed at step 80 in the known way by draining the wash liquid to outlet 12 via pump 13 and carrying out a high speed spin to centrifugally extract water from the laundry load.

The invention claimed is:

1. A laundry washing machine comprising:

a water container within which is supported a rotatable perforated drum for receiving a laundry load and to which a supply of water is admittable in use via a valve;

a motor for rotating the drum;

a detergent dispenser for dispensing detergent into the water container to create, with the water, a washing liquid for washing the laundry load, a liquid clarity sensor for sensing the clarity of the washing liquid in the water container; and a controller configured to:

prior to the commencement of a washing cycle of the laundry load, activate the valve, as part of a water fill, to admit a first amount of water to the water container for use in subsequently washing the laundry load during the washing cycle, activate the detergent dispenser to dispense a first amount of detergent into the water container;

sense a first washing liquid clarity measurement, using the liquid clarity sensor, of the washing liquid containing the first amounts of water and detergent, and determine the soil level of the laundry load using the first washing liquid clarity measurement, and after the water fill ends, commence a washing cycle of the laundry load wherein at least one wash parameter of the washing cycle is set by the controller based upon the determined soil level.

2. The laundry washing machine as claimed in claim 1, wherein the controller is further configured to receive an indication of the size of the laundry load, wherein the first amounts of water and detergent are dependent upon the received indication of the size of the laundry load.

3. The laundry washing machine as claimed in claim 1, wherein before commencing the washing cycle of the laundry load the controller optionally activates the detergent dispenser to dispense a further, second amount of detergent into the washing liquid, and wherein the total amount of detergent added to the water container for the washing cycle by the detergent dispenser is a wash parameter set by the controller based upon the determined soil level.

4. The laundry washing machine as claimed in claim 1, wherein determining the soil level of the laundry load comprises taking a second washing liquid clarity measurement, the soil level of the laundry load determined from a ratio, or a difference, between the first and second washing liquid clarity measurements.

5. The laundry washing machine as claimed in claim 4, further comprising a washing liquid level sensor for detecting the fill level of the washing liquid in the water container, wherein the first and second washing liquid clarity measurements are taken at respective predetermined different water fill levels of the water container.

6. The laundry washing machine as claimed in claim 1, wherein the controller is further configured to receive an indication of the size of the laundry load and, prior to the commencement of the washing cycle of the laundry load:

activate the valve to admit a second amount of water into the water container as a further part of the water fill;

carry out at least one controlled soil release from the laundry load into the washing liquid by activating the motor to control the drum's rotational speed over a limited duration of time;

sense a second washing liquid clarity measurement of the washing liquid containing the first and second amounts of water, using the liquid clarity sensor;

determine the soil level of the laundry load from a ratio, or a difference, between the first and second washing liquid clarity measurements; and based on the received indication of the size of the laundry load and the determined soil level, set said at least one wash parameter for washing the laundry load.

7. The laundry washing machine as claimed in claim 6, wherein the first amount of water is greater than about 75% of the amount of water added to the water container following admission of the second amount of water.

8. The laundry washing machine as claimed in claim 1, wherein the controller is further configured to receive an indication of the size of the laundry load and to determine the first amount of detergent based on the received indication of the size of the laundry load.

9. The laundry washing machine as claimed in claim 6, wherein the controller is further configured to pause motor rotation prior to and during sensing of the first and/or second water clarity measurement.

10. The laundry washing machine as claimed in claim 1, further comprising a temperature sensor and a heating element connected to the controller and configured such that washing liquid within the water container is raised to and/or maintained to/at a desired temperature while the first washing liquid clarity measurement is being sensed.

11. The laundry washing machine as claimed in claim 1, wherein the liquid clarity sensor is a turbidity sensor.

12. The laundry washing machine of claim 1, further comprising a washing liquid level sensor for detecting the fill level of the washing liquid in the water container, wherein the washing liquid level sensor is used to detect the admission of the first amount of water to the water container.

13. A method carried out by a controller of operating a laundry washing machine having a laundry load in a water container thereof, the method comprising the steps of:

admitting, as part of a water fill, a first amount of water to the water container for use in subsequently washing the laundry load during a washing cycle, dispensing a first amount of detergent to the water in the water container, the water and detergent forming a washing liquid, sensing a first washing liquid clarity measurement of the washing liquid containing the first amounts of water and detergent, determining the soil level of the laundry load, using the first washing liquid clarity measurement, and commencing the washing cycle of the laundry load after the water fill ends, wherein at least one wash parameter of the washing cycle is set by the controller based upon the determined soil level.

14. The method of operating a laundry washing machine as claimed in claim 13, further comprising receiving an indication of the size of the laundry load, wherein the first amounts of water and detergent are dependent upon the received indication of the size of the laundry load.

15. The method of operating a laundry washing machine as claimed in claim 13, further comprising, prior to commencement of the washing cycle of the laundry load, optionally dispensing a further, second amount of detergent into the washing liquid, wherein the total amount of detergent dispensed to the water container for the washing cycle is a wash parameter set by the controller based upon the determined soil level.

16. The method of operating a laundry washing machine as claimed in claim 13, wherein determining the soil level of the laundry load comprises taking a second washing liquid clarity measurement, the soil level of the laundry load determined from a ratio, or a difference, between the first and second washing liquid clarity measurements.

17. The method of operating a laundry washing machine as claimed in claim 16, wherein the first and second washing liquid clarity measurements are taken at respective different predetermined water fill levels of the water container.

18. The method of operating a laundry washing machine as claimed in claim 13, further comprising the steps of:

receiving an indication of the size of the laundry load;

admitting a second amount of water into the water container as a further part of the water fill;

carrying out at least one controlled soil release from the laundry load into the washing liquid by controlling the drum's rotational speed over a limited duration of time;

sensing a second washing liquid clarity measurement of the washing liquid containing the first and second amounts of water;

determining the soil level of the laundry load from a ratio, or a difference, between the first and second washing liquid clarity measurements; and based on the received indication of the size of the laundry load and the determined soil level, setting said at least one wash parameter for washing the laundry load.

19. The method of operating a laundry washing machine as claimed in claim 13, wherein the step of admitting a first amount of water to the water container comprises admitting water to the water container until the water level in the water container reaches a predetermined level.

20. The method of operating a laundry washing machine as claimed in claim 13, further comprising raising and/or maintaining the temperature of the washing liquid within the water container to/at a desired temperature while the first washing liquid clarity measurement is being sensed.

* * * * *